United States Patent [19]

Nakamura et al.

[11] Patent Number: 4,995,368

[45] Date of Patent: Feb. 26, 1991

[54] FUEL INJECTION TIMING APPARATUS

[75] Inventors: Masayuki Nakamura, Toyota; Kazuyuki Katayama, Obu; Yasuhiro Furuhashi, Anjo, all of Japan

[73] Assignees: Nippondenso Co., Ltd., Kariya; Hino Jidosha Kogyo Kabushiki Kaisha, Hino, both of Japan

[21] Appl. No.: 305,894

[22] Filed: Feb. 3, 1989

[30] Foreign Application Priority Data

Feb. 4, 1988 [JP] Japan ..... 63-024760

[51] Int. Cl.[5] ..... F02M 39/00

[52] U.S. Cl. ..... 123/501; 123/179 L; 464/2

[58] Field of Search ..... 123/179 L, 501, 502, 123/500, 364; 464/2-6

[56] References Cited

U.S. PATENT DOCUMENTS

| | | | |
|---|---|---|---|
| 3,654,776 | 4/1972 | Jingu | 123/501 |
| 3,683,879 | 8/1972 | Timms | 123/501 |
| 3,791,171 | 2/1974 | Hofman | 123/501 |
| 4,227,498 | 10/1980 | Eberl | 123/501 |
| 4,332,227 | 6/1982 | Bauer | 123/501 |
| 4,425,896 | 1/1984 | Murayama . | |
| 4,491,116 | 1/1985 | Morin | 125/502 |

FOREIGN PATENT DOCUMENTS

| | | | |
|---|---|---|---|
| 52-81523 | 6/1977 | Japan . | |
| 56-66035 | 6/1981 | Japan . | |
| 56-66036 | 6/1981 | Japan . | |
| 56-66039 | 6/1981 | Japan . | |
| 57-150235 | 9/1982 | Japan . | |
| 59-694 | 1/1984 | Japan . | |
| 59-32625 | 2/1984 | Japan | 123/501 |
| 59-100936 | 7/1984 | Japan . | |
| 59-117847 | 8/1984 | Japan . | |
| 59-121434 | 8/1984 | Japan . | |
| 59-36670 | 10/1984 | Japan . | |
| 60-24834 | 2/1985 | Japan . | |
| 60-45836 | 3/1985 | Japan . | |
| 61-94252 | 6/1986 | Japan . | |
| 62-13744 | 1/1987 | Japan . | |

*Primary Examiner*—Carl Stuart Miller

*Attorney, Agent, or Firm*—Cushman, Darby & Cushman

[57] ABSTRACT

A fuel injection timing apparatus comprises a pair of weights which rotate synchronously with an engine, so that adjustment of the injection timing of a fuel injection pump is carried out by means of the movement of these weights against the biasing forces of springs. This apparatus further comprises stopper members disposed at positions corresponding to both opposed ends of the weights to be movable in the direction perpendicular to the direction of the movement of the weights, and temperature-sensitive driving devices for moving the stopper members in accordance with ambient temperatures, which are arranged to operate such that, when the engine is started, the stopper members are made to project between the pair of weights in accordance with the ambient temperatures to restrain the weights which tend to return to their initial positions by the biasing forces of the springs.

8 Claims, 7 Drawing Sheets

FUEL INJECTION TIMING APPARATUS

BACKGROUND OF THE INVENTION

The present invention relates to a fuel injection timing apparatus or timer for use with a fuel injection pump.

In recent years, it has become a tendency in diesel engines to delay the fuel injection timing in comparison with that heretofore in use for the purpose of reducing NOx in particular. According to such method, however, although reduction of Nox can be promoted, other problems are caused. Specifically, the starting performance of an engine is deteriorated, especially at low temperatures, and also white smoke may be exhausted during idling of the engine.

To cope with the above problems, there has been proposed a fuel injection timing apparatus which is capable of adjusting the injection timing in correspondence with temperatures when an engine is started, as disclosed in Japanese Utility Model Examined Publication No. 59-36670. The invention related to this publication has also been assigned to one of the assignees of the invention of the present application. The apparatus disclosed in this publication comprises weights adapted to rotate synchronously with the engine so as to advance the injection timing in proportion to the degree of their movement, pins fixed to the weights, and a rod having a cam surface for urging the pins which rod is driven in correspondence with ambient temperatures. The apparatus is operated such that, when the engine is started at a low temperature, the weights are forcibly moved or opened through the pins.

In the apparatus according to the above publication, since the weights are biased always in a direction toward their closed position by means of springs, an extremely great driving force is required for moving, against the biasing force, the pins and the weights from a state in which the weights are fully closed toward their open position. This gives rise to another problem that a driving mechanism for the rod becomes large in size and, accordingly, the fuel injection timing apparatus is enlarged as a whole.

SUMMARY OF THE INVENTION

The invention has an object of providing a fuel injection timing apparatus which is simple in structure and is effective for readily starting an engine even at a low ambient temperature.

Another object of the invention is to provide a fuel injection timing apparatus which is able to control the fuel injection timing of an engine at a start thereof in accordance with ambient temperatures, and which is compact in size and easy to be mounted on a vehicle.

Still another object of the invention is to provide a fuel injection timing apparatus which can advance the fuel injection timing of an engine, when the engine is started at a low temperature, while effectively reducing NOx.

For the above end, according to the invention, at least one stopper is provided in a fuel injection timing apparatus which has weights for rotating synchronously with an engine and moving by centrifugal forces acting on the weights as a result of the rotation thereof so as to control the injection timing of a fuel injection pump in response to the movement of the weights. The stopper is operative in accordance with ambient temperatures to restrain the weights which tend to return their initial positions, so that the fuel injection timing of the engine at low rotational speeds is varied in accordance with the ambient temperature.

According to one aspect of the invention, there is provided a fuel injection timing apparatus which comprises: a pair of opposed weights adapted to be connected to an engine for synchronous rotation with the engine, the weights being movable away from each other in proportion to centrifugal forces acting on the weights as a result of rotation thereof and being adapted to be operatively connected to a fuel injection pump to control injection timing thereof in accordance with movement of the weights; a device for biasing the weights to return the same close to each other; at least one stopper provided adjacent opposed ends of the weights to be movable in a direction perpendicular to a direction of the movement of the weights; and a temperature-sensitive driving device for moving the stopper in accordance with ambient temperatures, whereby the stopper being moved in response to the ambient temperatures to project between the opposed ends of the weights and restrain the weights which tend to return to their initial positions by a force of the biasing device, so that the fuel injection timing is varied in response to the ambient temperatures when the engine is operated at low rotational speeds.

BRIEF DESCRIPTION OF THE DRAWINGS

The above-described objects and features, other objects, features, and advantages of the present invention will become apparent from the following description when it is considered in conjunction with the appended claims and the accompanying drawings.

In the accompanying drawings, FIGS. 1 to 5 show a fuel injection timing apparatus according to an embodiment of the invention, in which:

FIG. 1 is a partly sectional view of the apparatus;

FIG. 2 is a sectional view taken along the line II—II in FIG. 1;

FIG. 3 is an enlarged view of essential portions of FIG. 2;

FIG. 4 is an illustration showing a cam mechanism for adjusting the injection timing used in the apparatus of this embodiment; and FIG. 5 is a diagram showing the characteristic of the apparatus of the embodiment.

FIGS. 8*a*, 8*b* and 9 show still another embodiment of the invention, in which:

FIG. 8*a* being a front view and FIG. 8*b* being a side view; and

FIG. 9 is a diagram showing the characteristic of the apparatus of the embodiment, FIGS. 10 and 11 show a further embodiment of the invention, in which:

FIG. 10 is a sectional view of the apparatus according to the embodiment; and FIG. 11 is a diagram showing the characteristic of the apparatus of the embodiment, and FIGS. 12 and 13 show a still another embodiment of the invention, in which:

FIG. 12 is a sectional view of the apparatus according to the embodiment; and FIG. 13 is a diagram showing the characteristic of the apparatus of the embodiment.

DETAILED DESCRIPTION OF PREFERRED EMBODIMENTS

The present invention will be described hereinunder in connection with preferred embodiments thereof with reference to the accompanying drawings.

Figure 1:
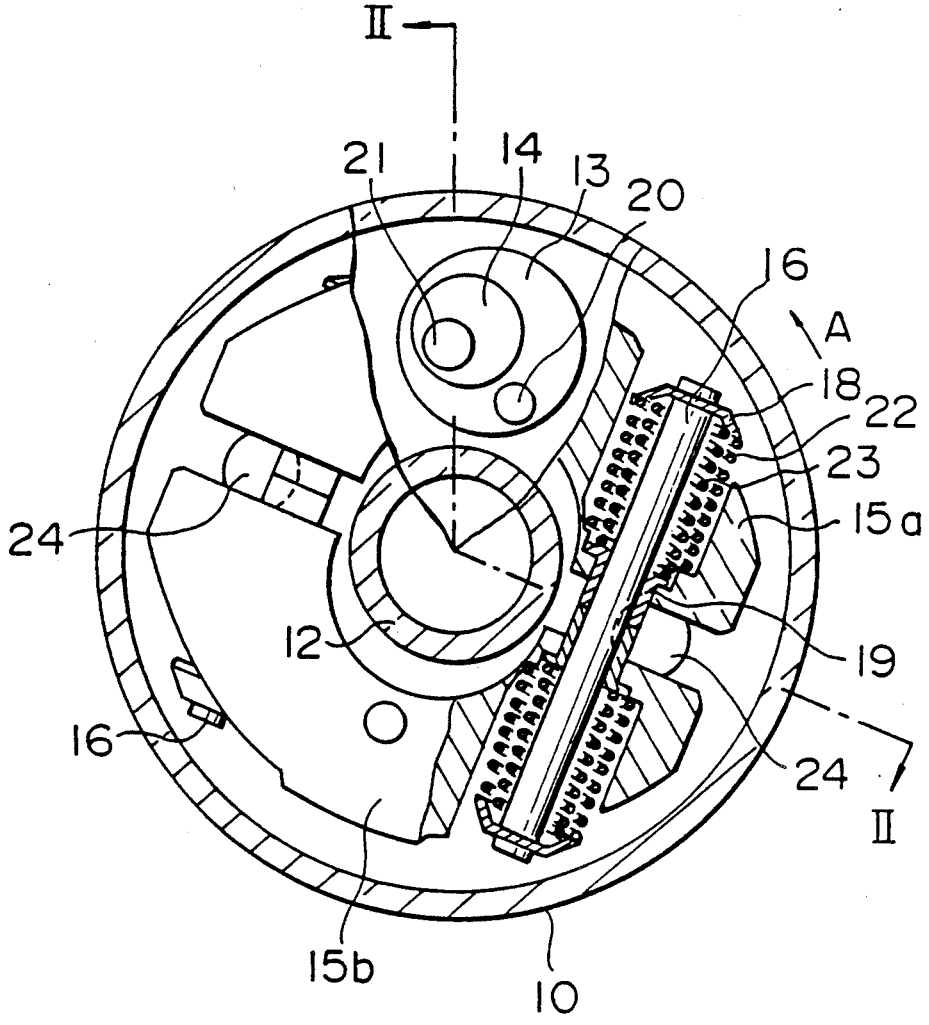
Figure 2:
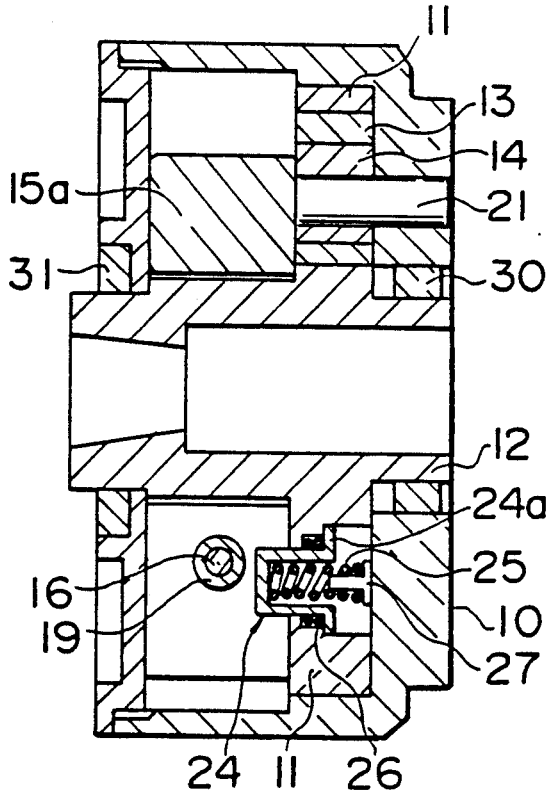

Referring to FIG. 1, a housing 10 of a bottomed-cylinder shape is adapted to be operatively connected to a diesel engine (not shown) so as to rotate synchronously with the engine in the direction of an arrow A shown in the drawing. As illustrated in FIG. 2, a disc-shaped hub 11 is received in the housing 10, and a hollow coupling member 12 for connection to a cam shaft of a fuel injection pump (not shown) is fixedly secured to a central portion of the hub 11. In addition, sealing members 30 and 31 are disposed between the housing 10 and the coupling member 12 for prevention of leakage of a lubricating oil.

The hub 11 is formed in its peripheral portions with a pair of holes arranged symmetrically, and first eccentric cams 13 are rotatably fitted in the respective holes. Each of the first eccentric cams 13 is formed eccentrically with a hole in which a second eccentric cam 14 in turn is fitted rotatably. Furthermore, a pair of semicircular-arc shaped weights 15*a* and 15*b* are arranged oppositely in such a manner as to surround the coupling member 12. These weights 15*a* and 15*b* are formed in their both opposed end portions with holes into which a pair of fitting pins 16 are slidably inserted. A pair of stoppers 18, 18 are mounted on opposite ends of each of the pins 16, and coil springs 22 and 23 are disposed in parallel to each other between each of the stoppers 18 and the corresponding weight 15 in concentrical relation to the associated pin 16. These springs abut against the corresponding weights 15 through stoppers 19 so as to stand against centrifugal forces on the weights 15*a* and 15*b*. The configurations of the stoppers 18 and 19 are designed such that only the biasing forces of the springs 22 are exerted on the weights 15*a* and 15*b* before and in an early stage of the movement or opening of the weights 15*a* and 15*b*, and the biasing forces of both of the springs 22 and 23 are exerted on the weights 15 when the weights 15*a* and 15*b* are moved to a predetermined degree of opening therebetween. The maximum stroke of each weight 15 is limited by means of the abutment of an outer periphery of the weight 15 against the inner wall surface of the housing 10.

Each of the first eccentric cams 13 is rotatably supported by one end of a pin 20 press-fitted in the corresponding weight 15, and each of the second eccentric cams 14 is rotatably supported by one end of a pin 21 provided on the housing 10. In consequence, a driving force of the housing 10 is transmitted to the hub 11 via the pins 21, the second eccentric cams 14 and the first eccentric cams 13.

Figure 4:
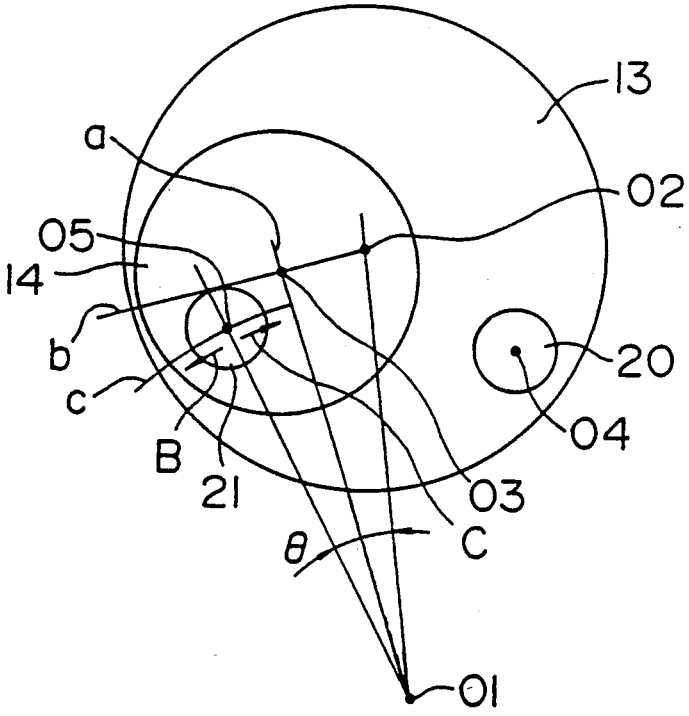

FIG. 4 is an enlarged view of these cams and pins, which illustrates the positional relationship among them when the engine is not operated. Referring to FIG. 4, a reference letter $O_1$ represents the center point of rotation of the housing 10 and, accordingly, of the hub 11 (hereinafter referred to as a first center point), $O_2$ the center point of the first eccentric cam 13 (hereinafter referred to as a second center point), $O_3$ the center point of the second eccentric cam 14 (hereinafter referred to as a third center point), $O_4$ the center point of the first pin 20 (hereinafter referred to as a fourth center point), and $O_5$ the center point of the second pin 21 (hereinafter referred to as a fifth center point). When the engine is not operated, the second and fourth center points $O_2$ and $O_4$ are located on one side and the fifth center point $O_5$ is located on the other side with respect to a line a connecting the first and third center points $O_1$ and $O_3$. In addition, the fifth center point $O_5$ is located inwardly of a line b connecting the second and third center points $O_2$ and $O_3$, that is, on the side on which the first center point $O_1$ is located.

Figure 3:
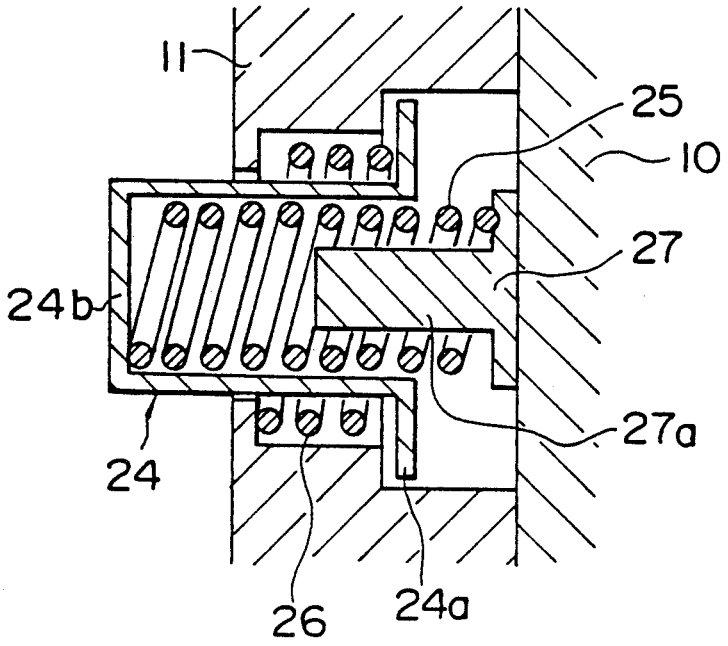

The hub 11 is formed in its portions corresponding to the opposed end portions of the weights 15*a* and 15*b* with a pair of axially-extending through holes. In each of the through holes, a stopper member 24 of a bottomed cylinder shape is disposed so as to be movable in the axial direction (see FIGS. 2 and 3). Outer peripheral portions of each of the stopper members 24, which face to the weights 15*a* and 15*b*, are respectively formed into planes, and the open end of each of the stopper members 24 is formed with a flange portion 24*a* over the entire circumference thereof. Each of the stopper members 24 is biased toward the weights 15 (to the left in FIG. 2) by means of a spring 25 disposed in each of the through holes and, at the same time, the flange portion 24*a* of each stopper member 24 is biased in a direction away from the weights 15 (to the right in FIG. 2) by means of a return spring 26 disposed around the stopper member 24. The springs 25 for biasing the stopper members 24 toward the weights 15 are made of a shape memory effect alloy. Each spring 25 is engaged at one end thereof with a seat member 27 secured to the housing 10 and at the other end thereof with a bottom portion 24*b* of the stopper member 24. The springs 25 made of the shape memory effect alloy are each so designed as to be deformed in correspondence with the ambient temperatures. The shape of each spring 25 is memorized such that, when the temperature changes from a low temperature to an elevated temperature, it is extended to increase in elastic modulus. Accordingly, when the temperature is low, the springs 25 are each in their contracted positions so that the set load of each spring applied to the stopper members 24 is small. Therefore, the stopper members 24 are urged by the respective return springs 26 so as to be retracted in the through holes, respectively. On the other hand, when the temperature changes from a low temperature to an elevated temperature, the springs 25 are caused to extend to increase their set load applied to the stopper members 24, with the result that the stopper members 24 project out from the respective through holes against the biasing forces of the return springs 26.

Figure 5:
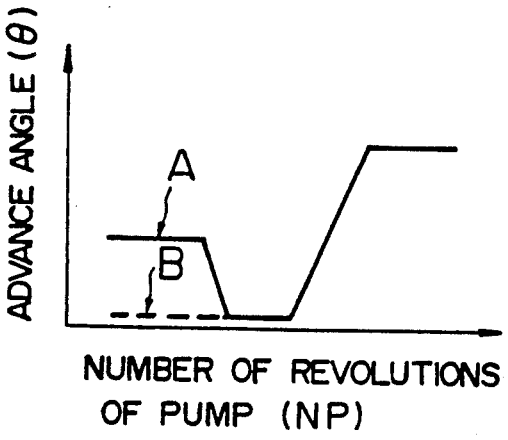

In the above-described arrangement, as the rotational speed or number of revolutions of the engine increases, the weights 15*a* and 15*b* are opened or moved away from each other due to the centrifugal forces against the biasing forces of the springs 22. Therefore, each of the first eccentric cams 13 which is connected to the corresponding weight 15 through the first pin 20 is caused to rotate about its center point $O_2$ in a counterclockwise direction as viewed in the drawing. The center point $O_3$ of the second eccentric cam 14 is also caused to rotate about the second center point $O_2$ in the counterclockwise direction. On the other hand, since the second pin 21 is connected to the housing 10 and since the distance between the first and fifth center points $O_1$ and $O_5$ is constant, the second pin 21 is allowed to move along and on a circular arc c which passes through the fifth center point $O_5$ and has its center located on the first center point $O_1$ (as shown in FIG. 4). Accordingly, the pin 21 moves in the direction of an arrow B until the second, third and fifth center points $O_2$, $O_3$ and $O_5$ come to be laid on a straight line. When the second, third and fifth center points $O_2$, $O_3$ and $O_5$ come to be laid on a straight line, the biasing forces of the springs 23 begin to be applied to the weights 15*a* and 15*b*. As the number of revolutions of the engine further increases, the weights 15*a* and 15*b* are opened against the biasing forces of the springs 22 and 23. Therefore, the second pin 21 moves in the direction of an arrow C in accordance with the movement of the weights 15*a* and 15*b*. In consequence, an angle $\theta$ defined by connecting, in the order to be described, the second center point $O_2$ which is a fixed point on the hub 11 and, accordingly, moves together therewith, the first center point $O_1$ which is the center point of rotation common to the housing 10 and the hub 11, and the fifth center point $O_5$ which is a fixed point on the housing 10 and, accordingly, moves together therewith, varies in such a manner that it is once increased and is then decreased in proportion to the degree of opening between the weights 15*a* and 15*b*, or in accordance with the increase in the number of revolutions of the engine. As a result, the relative angular displacement between the housing 10 which rotates synchronously with the diesel engine and the hub 11 which is connected to the cam shaft of the fuel injection pump, varies in such a way that it is once increased and is then decreased. Thus, an injection timing characteristic in which the injection timing is once delayed and is then advanced, can be obtained as shown by a solid line in FIG. 5.

In the above-described operation, when the ambient temperature is low, the springs 25 are each in their contracted positions so that the set load thereof applied to the stopper members 24 is small. Therefore, each stopper member 24 is pressed by the biasing force of the return spring 26 so as to be accommodated in the through hole while being in contact with the housing 10. In consequence, the weights 15*a* and 15*b* are allowed to move freely without contacting the stopper members 24 so that such characteristic as shown by the solid line A in FIG. 5 can be obtained. As a result, the starting performance of the engine at low temperatures can be improved and, at the same time, the fuel injection timing can be varied in such a way that it is once delayed and is then advanced in accordance with the increase in the number of revolutions.

When the ambient temperature rises, the springs 25 are each caused to extend from their positions mentioned above so that the set load applied to the stopper members 24 is increased. Therefore, the stopper members 24 are pressed against the biasing forces of the return springs 26 so as to tend to project out from the inside of the through holes toward the weights 15. At this time, the number of revolutions of the engine has increased and the weights 15*a* and 15*b* have been opened due to the centrifugal forces thereof against the biasing forces of the springs 22. Accordingly, the stopper members 24 are allowed to project between the weights 15*a* and 15*b* so that the weights 15*a* and 15*b* are prevented from returning to their close positions by the biasing forces of the springs 22 when the number of revolutions of the engine decreases. In consequence, the weights 15*a* and 15*b* are kept opened to a predetermined degree. In this case, the timing for injecting fuel is not advanced even when the engine is started as shown by a broken line B in FIG. 5, so that the reduction of NOx can be promoted. Since the portions of each stopper member 24 facing on the weights 15*a* and 15*b* are formed into planes, the stopper members 24 and the weights 15*a* and 15*b* are brought into face to face contact with each other so that the weights 15*a* and 15*b* can stably rest on the stopper members 24.

As described hereinabove, according to the described and illustrated embodiment, the injection timing can be adjusted in correspondence with the temperatures when the engine is started. Further, according to the described embodiment, by effectively utilizing the movement that the weights 15*a* and 15*b* are opened as the number of revolutions of the engine increases, the injection timing can be adjusted with a simple structure comprising the stopper members 24 and the springs 25 made of the shape memory effect alloy, without requiring any special driving mechanism for opening the weights 15*a* and 15*b* against the biasing forces of the springs 22 which urge the weights 15 toward their close positions. In consequence, it is possible to prevent the fuel injection timing apparatus from being enlarged as a whole, with the result that the mounting of the apparatus onto a vehicle becomes easy.

It is noted that the present invention is not limited to the above-described embodiment and can take various modifications without exceeding the scope of the claimed conception. Modifications of the above embodiment according to the present invention will now be described hereinunder. It is noted that, in the following description, only portions different from the above-described embodiment will be explained while omitting the explanation of the same arrangement and the same component parts.

Figure 6:
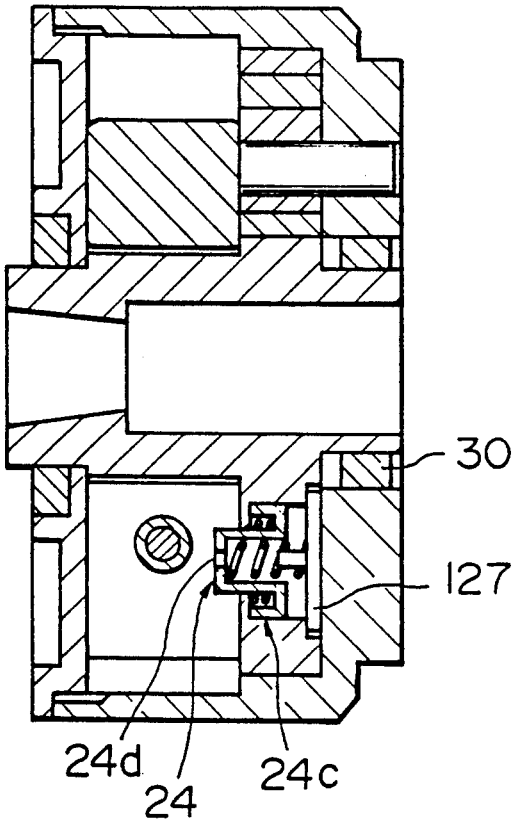
FIG. 6 is a sectional view showing an apparatus according to another embodiment of the invention.

In an embodiment illustrated in FIG. 6, seat members 127 are assembled to the hub 11 by being screwed into the same. In addition, a sliding surface 24*c* for sliding engagement with the through hole is formed contiguously to the flange portion 24*a* of each stopper member 24, and an introduction port 24*d* is formed in the bottom portion 24*b* of each stopper member 24 for introducing lubricating oil therethrough. With this arrangement, the fixing of the seat members 127 can be facilitated and the stopper members 24 can move smoothly in sliding contact due to the introduction of the lubricating oil to the sliding portions, thereby improving the operating ability.

Figure 7:
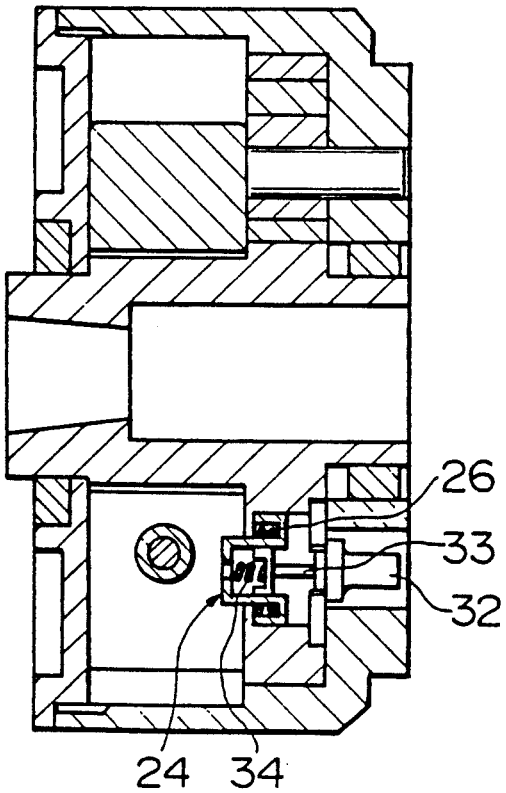
FIG. 7 is a sectional view of an apparatus according to still another embodiment of the invention.

In an embodiment illustrated in FIG. 7, thermowax devices 32 are used as temperature-sensitive driving means. As thermowax in the thermowax device 32 is caused to expand in accordance with an increase in the ambient temperature, the stopper member 24 is pressed through the medium of a transmitting member 33 provided at one end of the thermowax device 32 so as to be allowed to project out. In addition, since the thermowax device involves a problem, from the structural point of view, that leakage of the wax is caused to occur if the expansion of the thermowax is forcibly restricted in the middle thereof, a spring 34 the set load of which is greater than the maximum biasing force of the return spring 26 is disposed between the transmitting member 33 and the stopper member 24. With this arrangement, after the movement of the stopper member 24 in the direction of projection has been completed, the expansion of thermowax causes the spring to be compressed through the transmitting member 33, thereby making it possible to prevent the leakage of the wax.

Figure 8A:
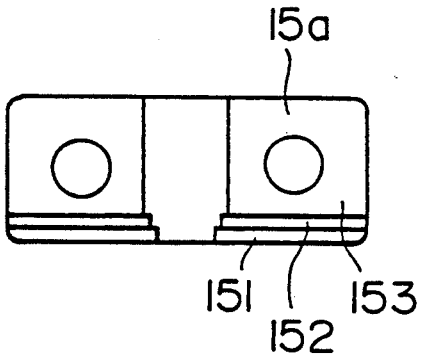
Figure 8B:
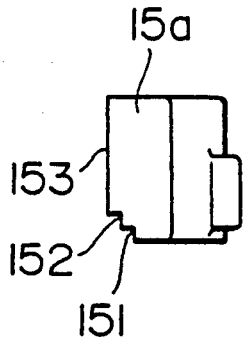
Figure 9:
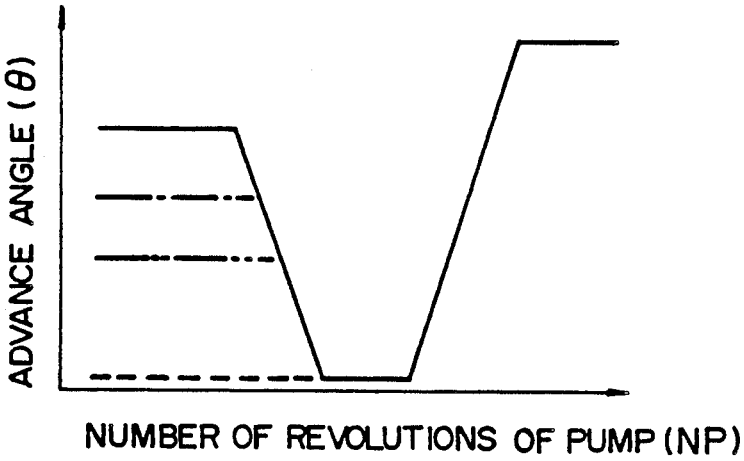

In an embodiment illustrated in FIGS. 8*a* and 8*b*, each of the weights 15 is formed with a plurality of engaging surfaces 151, 152 and 153 in a stepped manner for the engagement with the stopper members 24. This makes it possible to variably control the advance control characteristic of the injection timing stepwise in correspondence with the ambient temperatures, as shown in FIG. 9.

Figure 10:
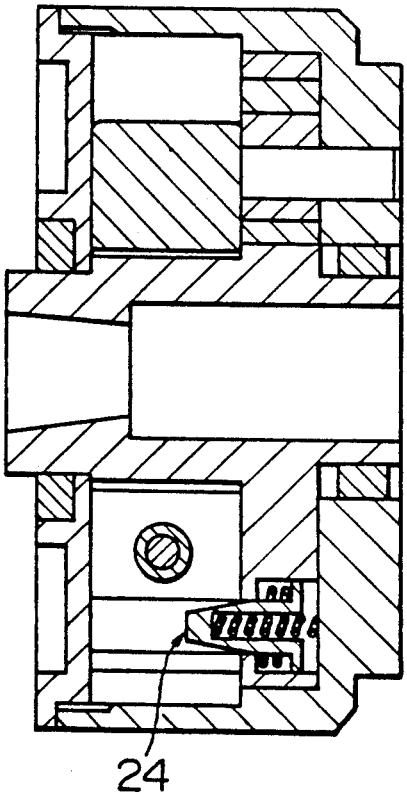
Figure 11:
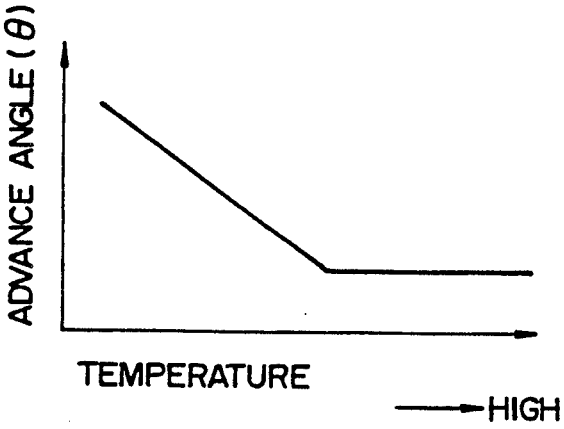

In an embodiment illustrated in FIG. 10, the stopper member 24 is shaped into a tapered form that is gradually tapered toward its free end. This makes it possible to variably control the advance control characteristic of the injection timing continuously in correspondence with the ambient temperatures, in the range of the small number of revolutions in which it is necessary to control the advance control characteristic in correspondence with the temperatures, as shown in FIG. 11.

Figure 12:
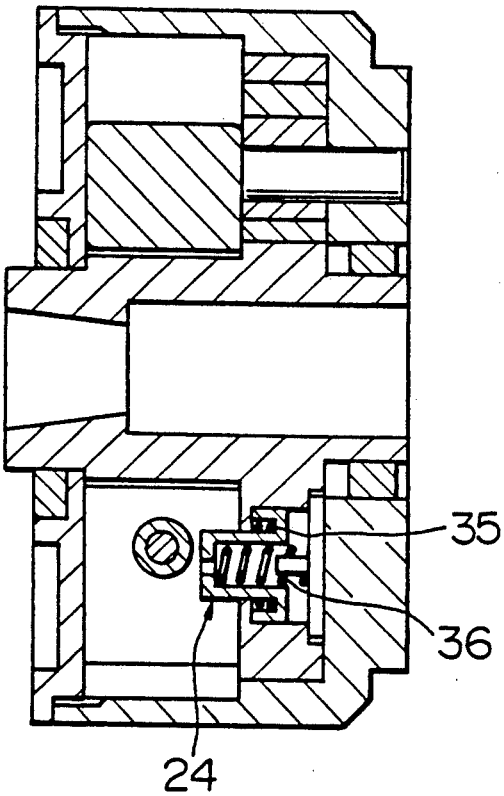

In the embodiments illustrated in FIGS. 1 to 4, the present invention has been described as being applied to the fuel injection timing apparatus which is operative to vary the injection timing in such a way that the injection timing is delayed for a certain range of low rotational speed of the engine and is then advanced in accordance with the increase in the number of revolutions. On the other hand, in an embodiment shown in FIG. 12, the present invention is applied to a fuel injection timing apparatus having an advance control mechanism alone. Referring to FIG. 12, in the present embodiment, return springs 35 are made of a shape memory effect alloy, while springs 36 for biasing the stopper members 24 toward the weights 15 are constituted by ordinary ones.

Figure 13:
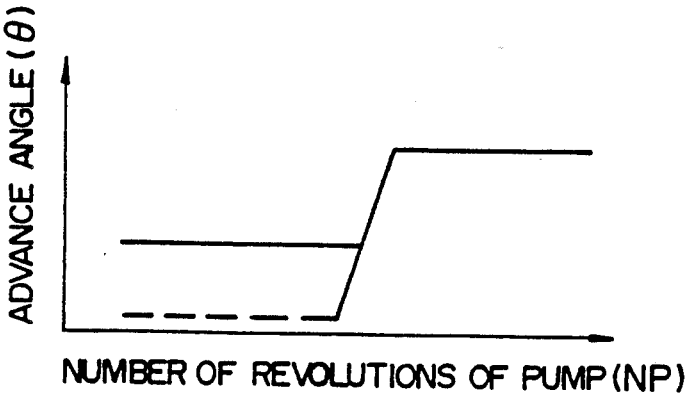

With the arrangement described above, when the temperature is low, the set load of the spring 36 is greater than the set load which is applied by the return spring 35 made of the shape memory effect alloy to the stopper member 24, so that the stopper members 24 tend to project out between the weights 15*a* and 15*b*. In this case, since a driver starts the engine while stepping o the gas, the number of revolutions of the engine is increased to cause the weights 15*a* and 15*b* to open temporarily. In consequence, the stopper members 24 are allowed to project between the weight 15*a* and 15*b* so as to block the movement of the weights 15 for returning to their initial positions. Thus, an injection characteristic in which the timing for injection of fuel is advanced when the number of revolutions is small can be obtained, as shown by a solid line in FIG. 13.

On the other hand, when the temperature is high, the set load of the return spring 35 is greater than the set load of the spring 36 which is applied to the stopper member 24, so that the stopper member 24 is not allowed to project out but accommodated in the through hole. In consequence, there can be obtained an injection timing characteristic in which the timing is not advanced even when the number of revolutions is small, as shown by a broken line in FIG. 13.

As has been described in the foregoing, according to the present invention, it is possible to adjust the fuel injection timing in response to the ambient temperatures when the engine is started, and it is also possible to adjust the injection timing by effectively utilizing the movement that the weights are opened as the number of revolutions of the engine increases, without requiring any special driving mechanism for moving the weights against the biasing forces of the springs, thereby making it possible to miniaturize the apparatus as a whole.

We claim:

1. A fuel injection timing apparatus comprising:

a pair of opposed weights adapted to be connected to an engine for synchronous rotation with the engine, said weights having an initial position and being movable away from each other in proportion to centrifugal forces acting on said weights as a result of rotation thereof and being adapted to be operatively connected to a fuel injection pump to control injection timing thereof in accordance with movement of said weights;

means for biasing said weights to return the same close to each other in the absence of said centrifugal forces;

at least one stopper provided adjacent opposed ends of said weights to be movable in a direction perpendicular to a direction of movement of said weights; and temperature-sensitive driving means for moving said stopper in accordance with ambient temperatures, whereby said stopper being moved in response to the ambient temperatures to project between the opposed ends of said weights and restrain said weights which tend to return to their initial positions by a force of said biasing means, so that the fuel injection timing is varied in response to the ambient temperatures when the engine is operated at low rotational speeds.

2. An apparatus according to claim 1, wherein said temperature-sensitive driving means comprises at least one spring made of a shape memory effect alloy and disposed for pressing said stopper.

3. An apparatus according to claim 1, wherein said temperature-sensitive driving means comprises a pressing device which is constructed to press said stopper by means of expansion of a thermowax.

4. An apparatus according to claim 1, wherein each of the opposed ends of said weights is provided with a plurality of steps for engagement with said stopper.

5. A fuel injection timing apparatus comprising:

a pair of opposed weights adapted to be connected to an engine for synchronous rotation with the engine, said weights having an initial position and being movable away from each other in proportion to centrifugal forces acting on said weights as a result of rotation thereof and being adapted to be operatively connected to a fuel injection pump to control injection timing thereof in accordance with movement of said weights;

means for biasing said weights to return the same close to each other in the absence of said centrifugal forces;

at least one stopper provided adjacent opposed ends of said weights to be movable in a direction perpendicular to a direction of the movement of said weights; and temperature-sensitive driving means for moving said stopper in accordance with ambient temperature, whereby said stopper being moved in response to the ambient temperatures to project between the opposed ends of said weights and restrain said weights which tend to return to their initial positions by a force of said biasing means, so that the fuel injection timing is varied in response to the ambient temperatures when the engine is operated at low rotational speeds, wherein said stopper is tapered off for engagement with said weights.

6. An apparatus according to claim 1, further comprising an eccentric cam mechanism through which said weights are connected to the fuel injection pump, said cam mechanism being arranged to control the injection timing of the fuel injection pump in a manner that the injection timing is once delayed over a predetermined range of the movement of said weights at low rotational speeds of the engine and is then advanced.

7. An injection timing apparatus for use with a fuel injection pump of a diesel engine comprising:

weight means for rotating synchronously with the engine and moving in a predetermined direction from an initial position due to centrifugal force of said rotating to control injection timing of the fuel injection pump in accordance with movement of said weight means; and stopper means for sensing ambient temperature and operative in response to a sensed temperature indicative of a starting of the engine to provide a projection in a direction perpendicular to said predetermined direction to block the movement of said weight means from returning to said initial position, so that the fuel injection timing is advanced when the engine is started.

8. An injection timing apparatus for use with a fuel injection pump of a diesel engine comprising:

a housing adapted to be connected to the engine for synchronous rotation therewith;

a pair of weights disposed oppositely around an axis of rotation of said housing for rotation together with said housing, said weights being movable away from each other relative to said housing in accordance with centrifugal forces acting on said weights as a result of rotation thereof;

an eccentric cam mechanism connected to said weights for transmitting movement of said weights to a fuel injection pump to control fuel injection timing thereof, said cam mechanism being arranged to control the fuel injection timing in a manner that the injection timing is once delayed over a predetermined range of the movement of said weights at low rotational speeds of the engine and is then advanced;

means for biasing said weights to return the same close to each other in the absence of said centrifugal forces;

at least a stopper provided in said housing at a position corresponding to opposed ends of said weights and movable in a direction perpendicular to a direction of the movement of said weights; and temperature-sensitive driving means for moving said stopper in accordance with ambient temperatures, whereby said stopper is moved in response to the ambient temperatures to project between the opposed ends of said weights and restrain said weights which tend to return to their initial positions by a force of said biasing means, so that the fuel injection timing is advanced when the engine is started at a low temperature, and thereafter the timing is once delayed and then is advanced again as the rotational speed of the engine increases.

* * * * *